US009150021B2

(12) United States Patent
Ishii et al.

(10) Patent No.: US 9,150,021 B2
(45) Date of Patent: Oct. 6, 2015

(54) LIQUID EJECTING HEAD UNIT, LIQUID EJECTING APPARATUS, AND LIQUID EJECTING HEAD SET

(71) Applicant: SEIKO EPSON CORPORATION, Tokyo (JP)

(72) Inventors: Hiroyuki Ishii, Shiojiri (JP); Hiroshige Owaki, Okaya (JP); Katsuhiro Okubo, Azumino (JP)

(73) Assignee: Seiko Epson Corporation, Tokyo (JP)

( * ) Notice: Subject to any disclaimer, the term of this patent is extended or adjusted under 35 U.S.C. 154(b) by 55 days.

(21) Appl. No.: 13/851,002

(22) Filed: Mar. 26, 2013

(65) Prior Publication Data

US 2013/0265363 A1 Oct. 10, 2013

(30) Foreign Application Priority Data

Apr. 4, 2012 (JP) ..... 2012-085166

(51) Int. Cl.

| | |
|---|---|
| ***B41J 2/15*** | (2006.01) |
| ***B41J 2/015*** | (2006.01) |
| ***B41J 2/145*** | (2006.01) |
| ***B41J 2/14*** | (2006.01) |
| ***B41J 2/155*** | (2006.01) |

(52) U.S. Cl.

CPC ..... *B41J 2/145* (2013.01); *B41J 2/14274* (2013.01); *B41J 2/155* (2013.01); *B41J 2202/19* (2013.01); *B41J 2202/20* (2013.01)

(58) Field of Classification Search

CPC ..... B41J 2202/19; B41J 2/14024
USPC ..... 347/20, 49, 85, 84, 138
See application file for complete search history.

(56) References Cited

U.S. PATENT DOCUMENTS

| | | | | | |
|---|---|---|---|---|---|
| 4,559,543 | A * | 12/1985 | Toganoh et al. | 347/32 |
| 4,635,080 | A | 1/1987 | Watanabe | |
| 5,450,110 | A * | 9/1995 | Sato et al. | 347/67 |
| 5,652,608 | A * | 7/1997 | Watanabe et al. | 347/50 |
| 5,964,032 | A * | 10/1999 | Orikasa et al. | 29/890.1 |
| 5,971,522 | A * | 10/1999 | Ono et al. | 347/40 |
| 6,068,367 | A * | 5/2000 | Fabbri | 347/49 |
| 6,151,051 | A * | 11/2000 | Ikeda et al. | 347/86 |
| 6,281,914 | B1 * | 8/2001 | Hiwada et al. | 347/50 |
| 6,315,390 | B1 * | 11/2001 | Fujii et al. | 347/42 |
| 6,652,062 | B2 * | 11/2003 | Umeyama et al. | 347/20 |
| 6,975,466 | B2 * | 12/2005 | Umeyama et al. | 359/896 |
| 2002/0001019 | A1 * | 1/2002 | Kudo et al. | 347/63 |
| 2003/0156171 | A1 * | 8/2003 | Yamaguchi et al. | 347/86 |
| 2005/0140723 | A1 * | 6/2005 | Taira | 347/40 |
| 2011/0221822 | A1 * | 9/2011 | Hagiwara et al. | 347/44 |

FOREIGN PATENT DOCUMENTS

| | | |
|---|---|---|
| CN | 102205716 | 10/2011 |
| JP | 2001-138542 | 5/2001 |
| JP | 2003-127390 | 9/2006 |
| JP | 2008-213239 | 9/2008 |
| JP | 2008-221745 | 9/2008 |

* cited by examiner

*Primary Examiner* — Matthew Luu
*Assistant Examiner* — Patrick King
(74) *Attorney, Agent, or Firm* — Workman Nydegger

(57) ABSTRACT

A liquid ejecting head unit includes: a liquid ejecting head that has a fixing face to be used for attachment and that ejects a liquid from a nozzle; a head fixing member that has stiffness higher than that of the fixing face and that is secured to the fixing face on the liquid ejecting head; and a support member that has an attachment face to which the liquid ejecting head is attached through the head fixing member.

15 Claims, 6 Drawing Sheets

LIQUID EJECTING HEAD UNIT, LIQUID EJECTING APPARATUS, AND LIQUID EJECTING HEAD SET

CROSS REFERENCES TO RELATED APPLICATIONS

The entire disclosure of Patent Application No. 2012-085166, filed Apr. 4, 2012, is incorporated by reference herein.

BACKGROUND

1. Technical Field

The present invention relates to a liquid ejecting head unit that has a liquid ejecting head such as an ink jet type recording head, and relates to a liquid ejecting apparatus that has the liquid ejecting head unit and a liquid ejecting head set.

2. Related Art

A liquid ejecting apparatus includes liquid ejecting heads that eject drops of various kinds of liquid. A typical example of a liquid ejecting apparatus is an image recording apparatus such as an ink jet type recording apparatus (a printer) that includes, for example, an ink jet type recording head (hereinafter referred to "a recording head") and that performs a recording action by ejecting drops of liquid ink from a nozzle of the recording head. In addition, the liquid ejecting apparatus is used for ejecting various kinds of liquid such as a color material to be used in a color filter such as that of a liquid crystal display, an organic material to be used in an organic electro luminescence (EL) display, and an electrode material to be used for producing an electrode. The recording head for the image recording apparatus ejects a liquid ink. A color material ejecting head for a display producing apparatus ejects red (R), green (G), and blue (B) color material liquid solutions. An electrode material ejecting head for an electrode producing apparatus ejects a liquid electrode material. A bioorganic material ejecting head for a chip producing apparatus ejects a bioorganic material liquid solution.

The printer described above includes a recording head unit in which a plurality of recording heads are fixed on a support member (for example, see JP-A-2008-221745). Each recording head introduces an ink from an ink supply source such as an ink cartridge into a pressure chamber (a pressure generating chamber) and actuates a pressure generating unit such as a piezoelectric element or a heater element. Consequently, the ink in the pressure chamber is subjected to pressure fluctuations. A nozzle ejects the ink in the pressure chamber as ink drops by utilizing the pressure fluctuations. Since a head casing of the recording head is secured to a support member by using screws or the like, the recording head is secured to the support member.

Here, a resin which is easy to mold is usually used for the head casing due to manufacturing cost and the like. However, since the resin has a lower stiffness than metals or the like, there is a problem that when the head casing is secured to the support member and the recording head is attached to the support member the head casing that is pressed onto the support member may become deformed. Consequently, there is a problem that the recording head and the support member may become misaligned and that it is necessary to check for such positional misalignment of the recording head after attaching the recording head to the support member. For example, in the case of having to replace the recording head because of a failure, after fixing a new recording head on the support member, the ink drop is ejected from the new recording head and the landing position of the ink drop is confirmed.

If misalignment of the landing position of the ink drop exceeds an allowable area, the position of the recording head is adjusted and the landing position of the ink drop is confirmed again. Consequently, the work for attaching the recording head to the support member of the recording head unit is complicated. This similarly applies to the case of a liquid ejecting head as well as the case of the recording head.

SUMMARY

An advantage of some aspects of the invention is that a liquid ejecting head can be easily attached to a support member in a liquid ejecting head unit and a liquid ejecting apparatus.

According to a first aspect of the invention, a liquid ejecting head unit includes: a liquid ejecting head that has a fixing face to be used for attachment and that ejects a liquid from a nozzle; a head fixing member that has stiffness higher than that of the fixing face and that is secured to the fixing face on the liquid ejecting head; and a support member that has an attachment face to which the liquid ejecting head is attached through the head fixing member.

Furthermore, according to a second aspect of the invention, a liquid ejecting head unit includes: a liquid ejecting head that has a nozzle face provided with a nozzle, a pressure chamber that communicates with the nozzle, and a pressure generating section that induces pressure fluctuations in the pressure chamber, the liquid ejecting head being actuated to eject a liquid from the nozzle by inducing the pressure fluctuations in the pressure chamber; and a support member on which a plurality of liquid ejecting heads are mounted. The support member has an attachment face perpendicular to the nozzle face of each liquid ejecting head to be mounted on the attachment face. Each liquid ejecting head includes a head casing that contains at least a part of the pressure generating section, and a head fixing member having stiffness higher than the head casing. The head fixing member is secured to a face opposing the attachment face of the support member in the head casing in a state in which a relative position between the nozzle and the head fixing member is defined. When the head fixing member is pressed onto and is fixed to the attachment face of the support member, the liquid ejecting head is mounted on the support member.

According to the above aspects, since the liquid ejecting head is fixed to the support member through the head fixing member having the stiffness higher than that of the head casing and hardly deformed, when the liquid ejecting head is mounted on the support member, misalignment of the liquid ejecting head can be prevented. Thus, it is possible to enhance workability of attaching the liquid ejecting head to the support member. Also, since the liquid ejecting head is pressed onto and is fixed to the attachment face on the support member, positioning of the liquid ejecting head becomes easy. In particular, when the liquid ejecting head is replaced due to a failure or the like, the positioning of the liquid ejecting head becomes easy. Accordingly, it is easy for a customer who uses the liquid ejecting apparatus to replace the liquid ejecting head.

In the liquid ejecting head unit according the aspects, preferably, the head fixing member may include an engagement section at a side facing the support member; the support member may include an engagement receiving section on the attachment face; and the engagement section is fitted in the engagement receiving section and the head fixing member is secured to the support member.

According to the above structure, it is possible to enhance an accuracy of positioning the liquid ejecting head in the direction of the nozzle face.

According to a third aspect of the invention, a liquid ejecting apparatus has the liquid ejecting head unit according to the first and second aspects of the invention.

According to a fourth aspect of the invention, a liquid ejecting head set to be mounted on an attachment face of a support member includes: a liquid ejecting head that has a fixing face to be used for attachment and that ejects a liquid from a nozzle; and a head fixing member that has stiffness higher than that of the fixing face and that is secured to the fixing face of the liquid ejecting head. The head fixing member includes a fixing member attachment face to be attached to the attachment face of the support member.

Furthermore, according a fifth aspect of the invention, a method for producing a liquid ejecting head unit includes: using a liquid ejecting head that has a fixing face and ejects a liquid from a nozzle, a head fixing member that has stiffness higher than that of the fixing face, and a support member that has an attachment face; securing the fixing face on the liquid ejecting head to the head fixing member in a state in which a relative position between the nozzle and the head fixing member is defined; and pressing and securing the head fixing member, on which the liquid ejecting head is mounted, to the attachment face of the support member in a state in which a relative position between the head fixing member and the attachment face.

BRIEF DESCRIPTION OF THE DRAWINGS

The invention will be described with reference to the accompanying drawings, wherein like numbers reference like elements.

DESCRIPTION OF EXEMPLARY EMBODIMENTS

An embodiment according to the invention will be described below with reference to the drawings. It should be noted that the invention is not limited to the embodiment unless there is a specific description that the invention is limited to the embodiment, although a preferable example of the invention is described here. Hereinafter, an ink jet type recording apparatus (hereinafter referred to "a printer 1") equipped with a recording head unit 2 which is a kind of liquid ejecting head unit will be described below as an example of a liquid ejecting apparatus of the invention.

Figure 1A:
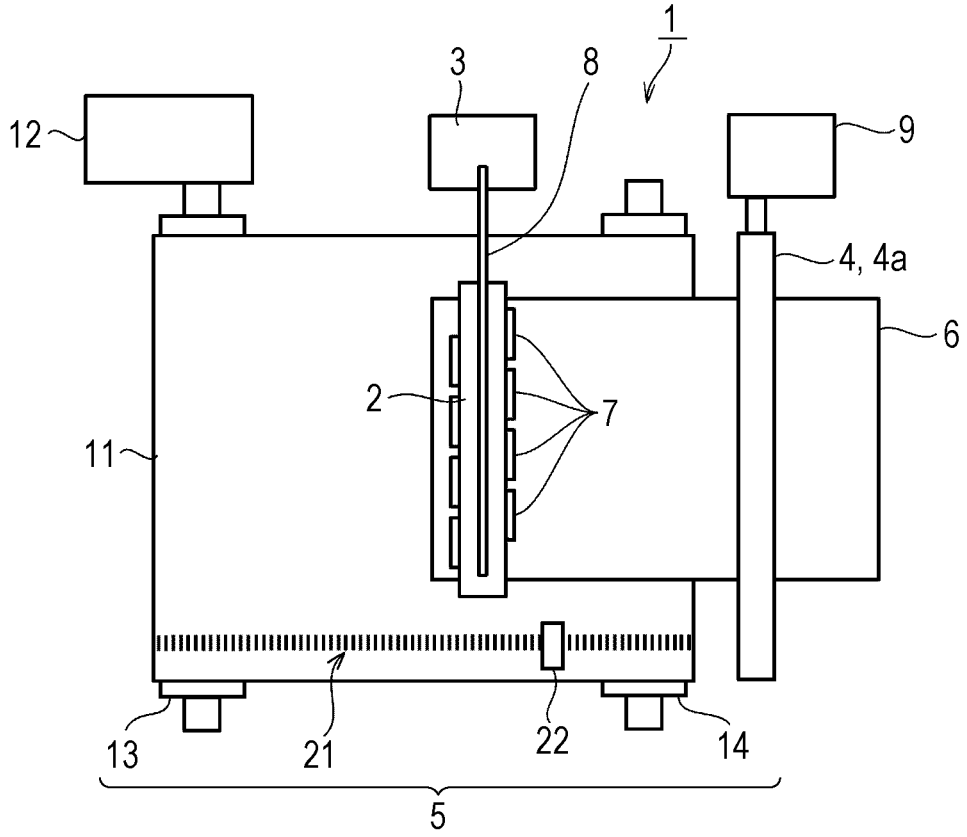
FIG. 1A is a schematic plan view of a printer.
Figure 1B:
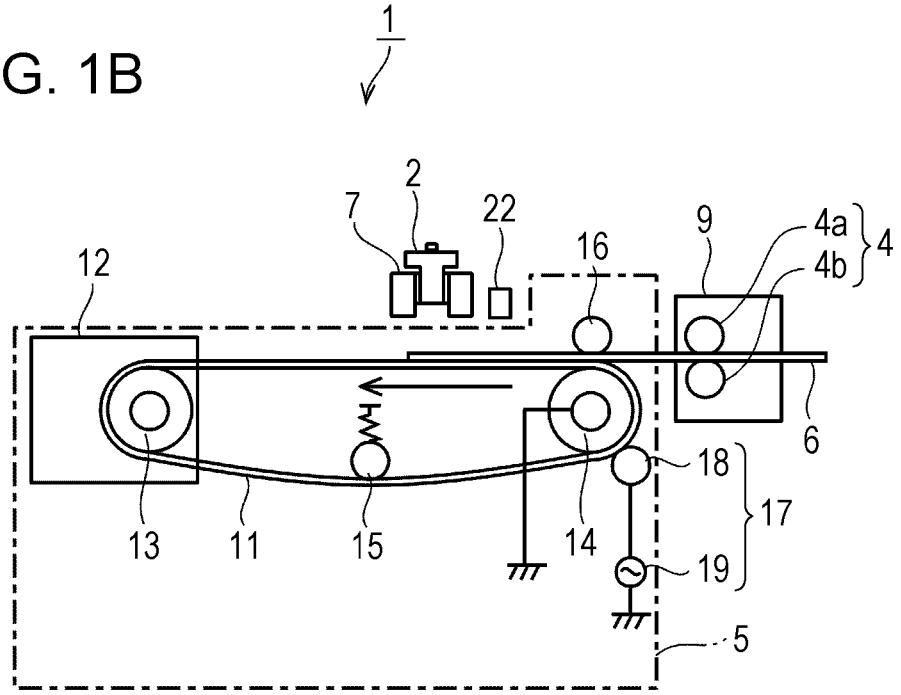
FIG. 1B is a schematic side elevation view of the printer.

FIG. 1A is a schematic plan view of a printer 1. FIG. 1B is a schematic side elevation view of the printer 1. The printer 1 includes a recording head unit 2, an ink tank 3, a paper feed roller unit 4, and a transporting mechanism 5. The recording head unit 2 includes a plurality of recording heads 7 (a kind of liquid ejecting head) arranged in a paper width direction (in a direction perpendicular to a transporting direction of a recording paper 6). The recording paper 6 is a kind of recording medium or target for liquid ejection. The ink tank 3 is a kind of storing member (a liquid supply source) that contains an ink to be supplied to the recording head unit 2. The ink in the ink tank 3 is supplied through an ink supply tube 8 to the recording head unit 2.

The paper feed roller unit 4 is disposed upstream from the transporting mechanism 5 and includes a pair of upper and lower rollers 4*a* and 4*b* that can be rotated synchronously in opposite directions while pinching the recording paper 6 which is supplied from a feeding unit (not shown). The paper feed roller unit 4 is driven by power from a paper feed motor 9 and supplies the recording paper 6 to the transporting mechanism 5 after the paper feed roller unit 4 together with a skew correcting roller (not shown) corrects a skew orientation of the recording paper 6 with respect to a transporting direction of the recording paper 6 and a deviation of the recording paper 6 with respect to a direction perpendicular to the transporting direction.

The transporting mechanism 5 includes a transporting belt 11, a transporting motor 12, a driving roller 13, a driven roller 14, a tension roller 15, a pinching roller 16, and a belt charging unit 17. The transporting motor 12 is a driving power source for the transporting mechanism 5 and transmits a driving power to the driving roller 13. The transporting belt 11 is an endless belt that spans between the driving roller 13 and the driven roller 14. The tension roller 15 contacts an inner face of the transporting belt 11 between the driving roller 13 and the driven roller 14 and places the transporting belt 11 under tension by utilizing a biasing member such as a spring. The pinching roller 16 is disposed directly above the driven roller 14 with the transporting belt 11 therebetween and presses the recording paper 6 toward the transporting belt 11.

The belt charging unit 17 includes a charging roller 18 and a charging power source 19. The transporting belt 11 is placed between the charging roller 18 and the driven roller 14, and the charging roller 18 is disposed upstream and downward from the driven roller 14 in such a manner as to contact the transporting belt 11. The charging power source 19 is electrically connected to the charging roller 18 in order to apply an alternating voltage (an AC voltage) to the charging roller 18. The driven roller 14 is connected to the earth and is an electrode opposing the charging roller 18 with the transporting belt 11 therebetween. The charging power source 19 supplies an electric charge through the charging roller 18 to the transporting belt 11, so that the belt charging unit 17 charges the transporting belt 11. Electric polarization is generated on the recording paper 6 mounted on the charged transporting belt 11, so that an electric static attractive force is generated between the recording paper 6 and the charged transporting belt 11. In addition, the pinching roller 16 presses the recording paper 6 mounted on the charged transporting belt 11 onto the belt 11, thereby improving the close contact between the recording paper 6 and the transporting belt 11.

The transporting belt 11 is provided on its whole outer peripheral face with a linear scale 21. The linear scale 21 has a plurality of slit-like detecting patterns in the transporting direction of the transporting belt 11 at a certain pitch (for example, 360 dots per inch (dpi)). The detecting patterns of the linear scale 21 are optically detected by a detecting head 22 and a detected signal is inputted into a control unit (not shown) in the printer 1 as an encoder signal. Accordingly, the control unit can grasp a transporting amount of the recording paper 6 transported by the transporting mechanism 5 (the transporting belt 11) on the basis of the encoder signal. The encoder signal defines a timing at which a driving signal is generated for driving a piezoelectric element 41 (mentioned later by referring to FIG. 6) of the recording head 7.

Figure 2:
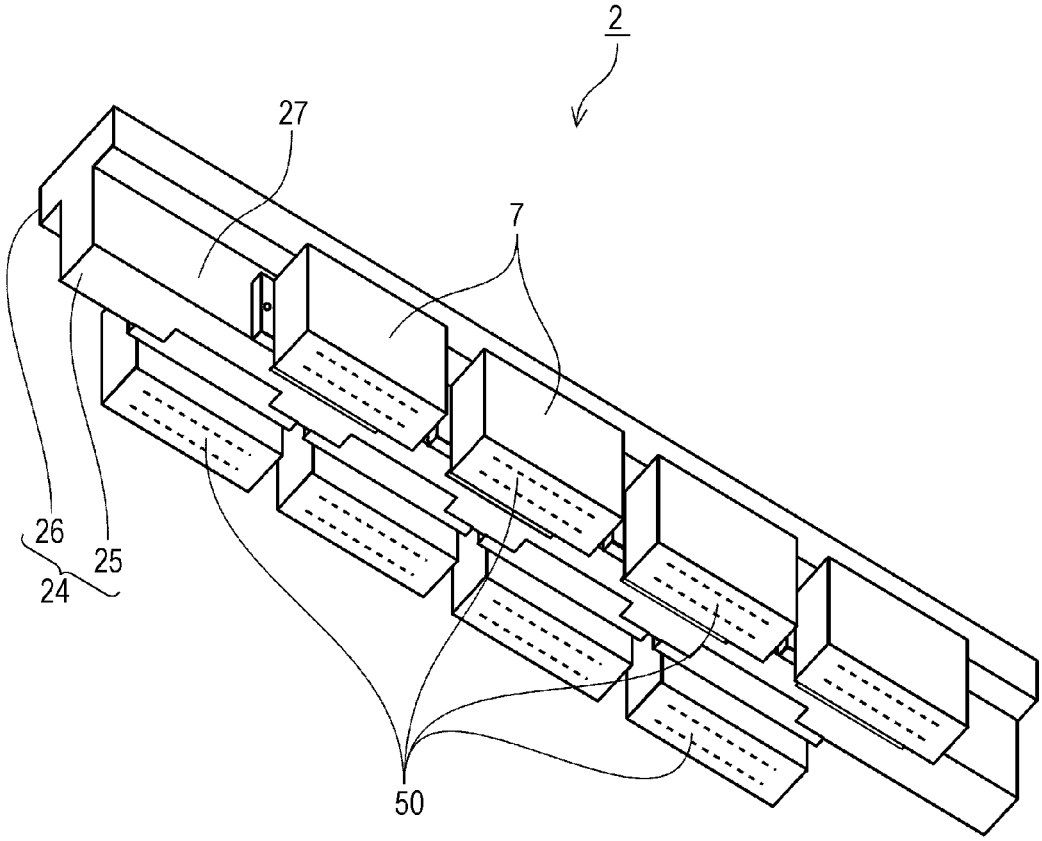
FIG. 2 is a perspective view of a recording head unit taken from the side of nozzle faces.
Figure 3A:
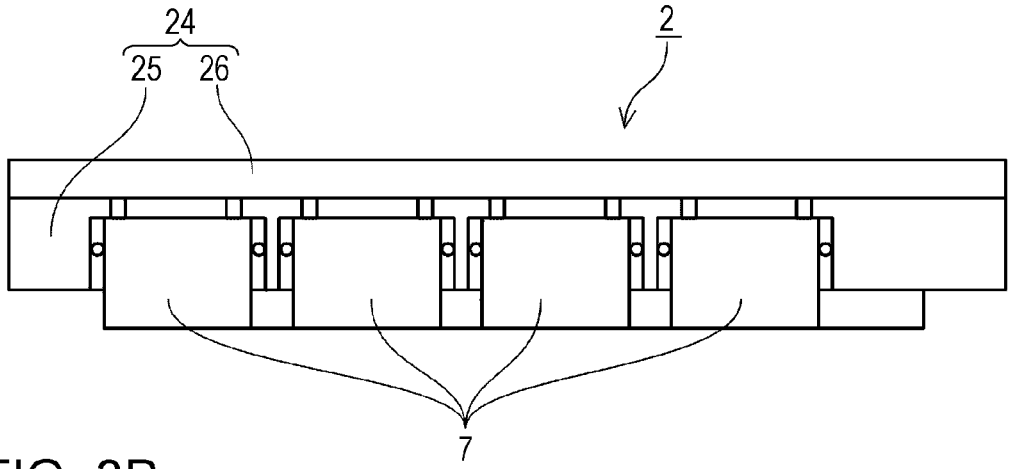
FIG. 3A is a schematic side elevation view of the recording head unit.
Figure 3B:
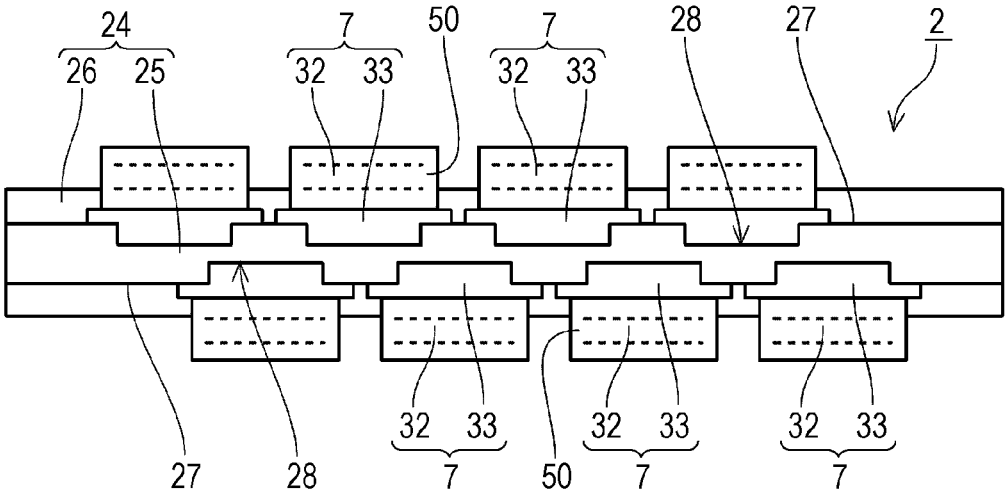
FIG. 3B is a schematic bottom view of the recording head unit.
Figure 3C:
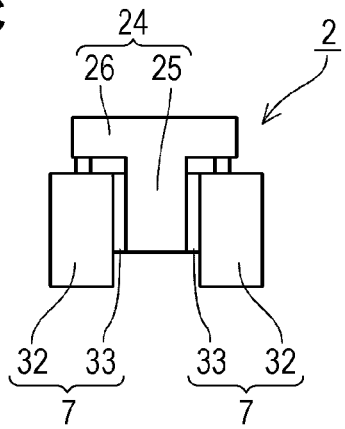
FIG. 3C is a schematic front elevation view of the recording head unit.

FIG. 2 is a perspective view of the recording head unit 2 taken from the side of nozzle faces 50. FIG. 3A is a schematic side elevation view of the recording head unit 2. FIG. 3B is a schematic bottom view of the recording head unit 2. FIG. 3C is a schematic front elevation view of the recording head unit 2. The recording head unit 2 in the embodiment includes two arrays each having four recording heads 7 on a base plate 24 (corresponding to a support member in the invention).

The base plate 24 is a support member that is elongated in the direction of the arrays of the recording heads 7 and is made of a metal material such as stainless steel (SUS). The base plate 24 in the embodiment has a T shape in cross section (see FIG. 3C). In more detail, the base plate 24 includes a vertical portion (a support wall portion) 25 that has attachment faces 27 perpendicular to the nozzle face 50 (a nozzle forming base plate 45 (see FIG. 6)) of each recording head 7 and a horizontal portion (a flange portion) 26 that reinforces the vertical portion 25 (the base plate 24) in the upper part of the vertical portion 25.

Figure 4A:
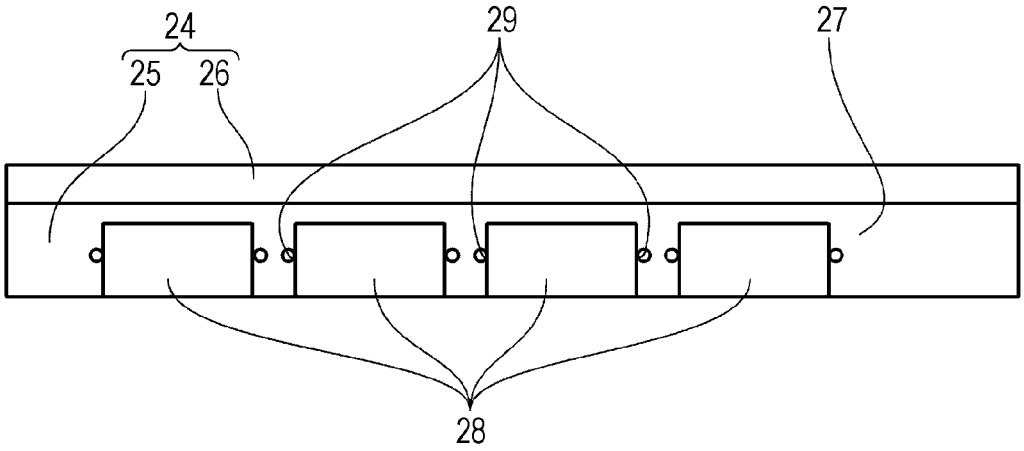
FIG. 4A is a schematic side elevation view of a base plate.
Figure 4B:
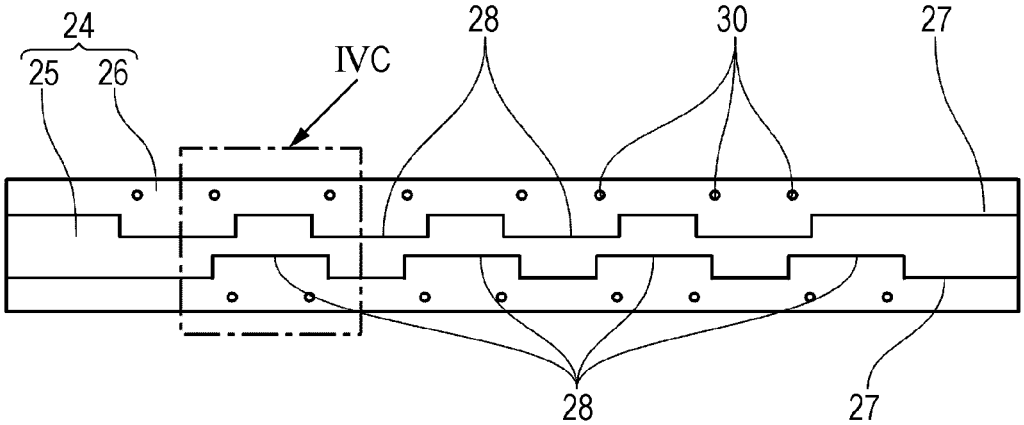
FIG. 4B is a schematic bottom view of the base plate.
Figure 4C:
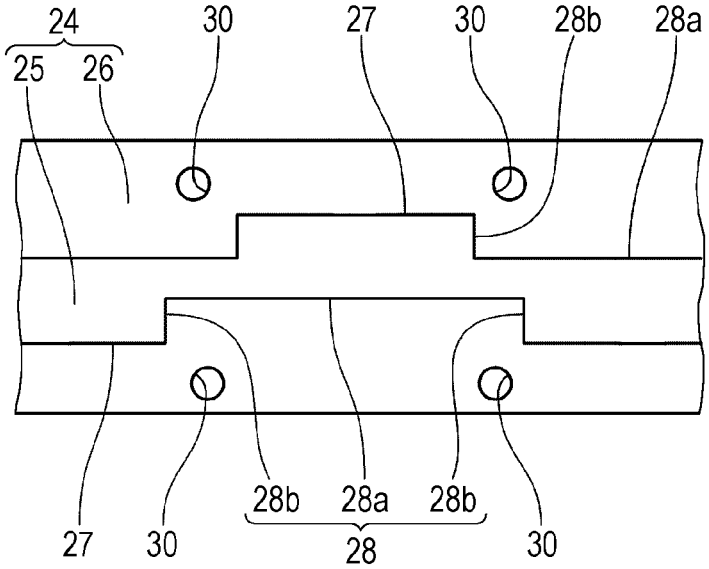
FIG. 4C is an enlarged bottom view of an area IVC shown in FIG. 4B.

The vertical portion 25 is formed into a thick plate that extends in the same direction as the arrays of the recording heads 7. Surfaces that vertically intersect the thickness direction of the vertical portion 25, that is, both front and back sides of the vertical portion 25 constitute the attachment faces 27. As shown in FIG. 4A to FIG. 4C, the attachment face 27 on the one side of the vertical portion 25 is provided with four engagement recesses 28 (corresponding to an engagement receiver in the invention) that can receive four engagement projections 63 (mentioned later) of the recording heads 7, respectively. Each engagement recess 28 is formed by denting the vertical portion 25 from one side to the other side in the thickness direction. Each engagement recess 28 includes a first receiving face 28*a* that defines a position in a direction perpendicular to a nozzle array 49 (see FIG. 7) in a surface parallel to the nozzle face 50 of each recording head 7, and a second receiving face 28*b* that defines a position in a direction of a nozzle array 49 in a surface parallel to the nozzle face 50 of each recording head 7 (see FIG. 4C). That is, the first receiving face 28*a* is a face parallel to each attachment face 27 while the second receiving face 28*b* is a face perpendicular to the first receiving face 28*a* and the nozzle face 50. Either one of the second receiving faces 28*b* and 28*b* disposed on the two sides of the engagement recess 28 serves as a positioning receiving face that defines a position in the nozzle array direction of the recording head 4. Each engagement recess 28 in the embodiment extends from a lower end (a side opposite the horizontal portion 26) to an intermediate part of an upper end (a side of the horizontal portion 26). That is, the lower end face of the engagement recess 28 is open while the upper end thereof has a ceiling wall formed with the vertical portion 25. Similarly, the attachment face 27 on the other side of the vertical portion 25 is also provided with four engagement recesses 28. In the embodiment, since one array of the recording heads 7 and another array of the recording heads 7 are shifted from each other by half a distance of a pitch in the arrays of the recording heads 7, the array of the engagement recesses 28 on one side and the array of the engagement recesses 28 on the other side are shifted from each other by half a distance of a pitch in the arrays of the recording heads 7, corresponding to the arrays of the recording heads 7. Each engagement recess 28 is provided on its opposite edges in the array direction of the recording heads 7 with tapped holes 29 (see FIG. 4A) for mounting the recording head 7.

The horizontal portion 26 is parallel to the nozzle face 50 of each recording head 7 and is formed into a thick plate-like shape. The horizontal portion 26 in the embodiment is formed into a hood-like shape that extends outward from the opposite attachment faces 27 of the vertical portion 25. The horizontal portion 26 is provided at the side of the recording head 7 with a communication hole 30 that communicates with a connecting channel of each recording head 7. The communication hole 30 at the side opposite the recording head 7 is connected to the ink supply tube 8. Thus, the ink contained in the ink tank 3 is supplied through the ink supply tube 8 and the communication hole 30 to each recording head 7.

Figure 5A:
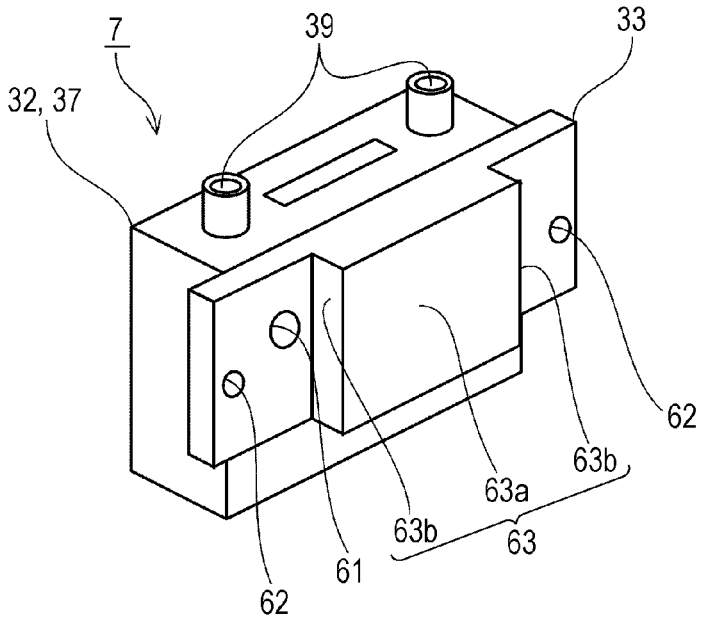
FIG. 5A is a schematic perspective view of a recording head, illustrating the recording head on which a head fixing member is mounted.
Figure 5B:
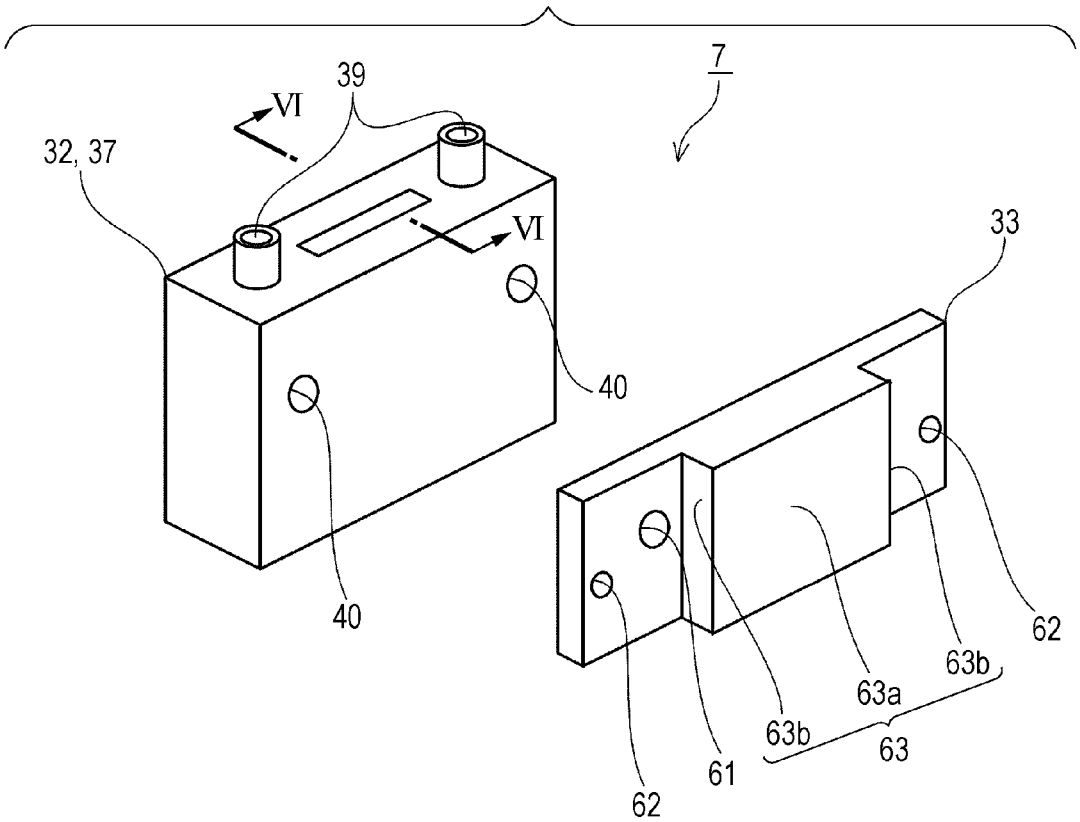
FIG. 5B is a schematic perspective view of the recording head, illustrating the recording head from which the head fixing member is removed.
Figure 6:
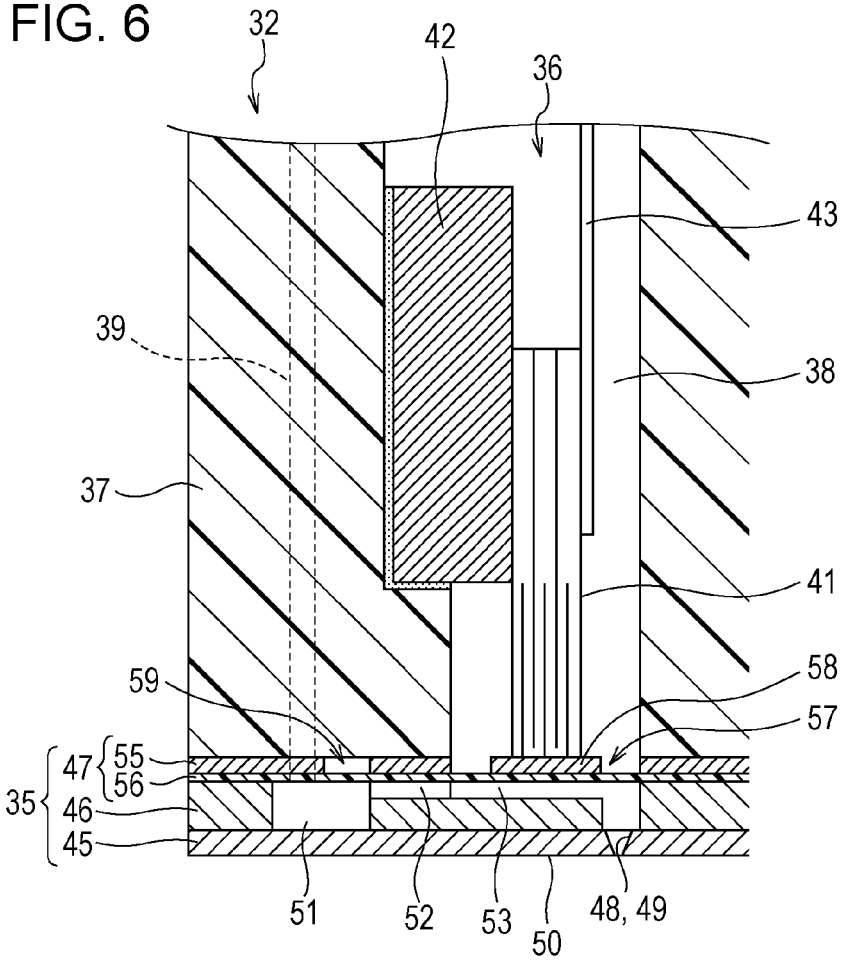
FIG. 6 is a cross section view of the recording head taken along lines VI-VI in FIG. 5B.

FIG. 5A is a schematic perspective view of each recording head 7, illustrating a structure in which a head fixing member 33 is mounted on the recording head 7. FIG. 5B is a schematic perspective view of the recording head 7, illustrating a structure in which the head fixing member 33 is removed from the recording head 7. FIG. 6 is a cross section view of the recording head 7 taken along the line VI-VI in FIG. 5B. A structure of the other nozzle array 49 is omitted in FIG. 6, since the structure is symmetrical in the right and left directions in the drawing.

As shown in FIG. 5A and FIG. 5B, each recording head 7 includes a recording head body 32 that ejects the ink from the nozzle 48, and the head fixing member 33 mounted on a side, opposing the attachment faces 27, of the recording head body 32. A face, opposing the head fixing member 33, of the recording head body 32 is a fixing face while a face, opposing the attachment faces 27, of the head fixing member 33 is a fixing member side attachment face.

As shown in FIG. 6, the recording head body 32 includes a head casing 37, an oscillator unit 36, and a channel unit 35. As described above, the structure corresponding to the other nozzle array 49 is symmetrical in the right and left direction, and therefore an explanation of the one side is omitted here.

The head casing 37 is a casing member that constitutes the most of an upper face and a side face of the recording head body 32. A piezoelectric element 41 (corresponding to a pressure generating element in the invention) is contained in the head casing 37. To be more specific, the head casing 37 is a hollow box-like member made of, for example, a resin such as an epoxy resin. As shown in FIG. 6, a channel unit 35 is fixed on a distal end of the head casing 37 so that the nozzle forming base plate 45 is exposed.

The head casing 37 is provided in its interior with an accommodating hollow space 38 for containing the oscillator unit 36, and a casing channel 39 for supplying the ink from the ink tank 3 to the channel unit 35 so that the space 38 and channel 39 extend through the head casing 37 in the height direction of the head casing 37. As shown in FIG. 5A and FIG. 5B, an upper end of the casing channel unit 39 extends from an upper face of the head casing 37 to the horizontal portion 26 of the base plate 24 so as to communicate with the communication hole 30. Also, a lower end of the casing channel unit 39 communicates with a reservoir 51 (mentioned later by referring to FIG. 6) through an ink induction port of the channel unit 35. As shown in FIG. 5A and FIG. 5B, the head casing 37 is provided in its face opposing the attachment faces 27 with two tapped holes 40 that are open at opposite ends thereof in the direction of the nozzle array 49 and that serve to secure the head fixing member 33 to the head casing 37.

As shown in FIG. 6, the oscillator unit 36 includes a piezoelectric element group including a plurality of piezoelectric elements 41 (pressure generating elements), a flexible cable 43 (a wiring member), and the like. The piezoelectric elements 41 that constitute the piezoelectric element group are formed into fine-toothed combs that are elongated in a longitudinal direction and have slits with very narrow width of several tens of micrometers (μm). Each piezoelectric element 41 is a longitudinal vibration type piezoelectric element that can expand and contract in a longitudinal direction. A fixed end of each piezoelectric element 41 contacts a fixing plate 42 and is secured to the fixing plate 42 so that a free end of the element 41 projects outward from a distal end edge of the fixing plate 42 in a so-called cantilever state. As described later, the distal free end of each piezoelectric element 41 is connected to an island portion 58 that constitutes a diaphragm section 57 in the channel unit 35. An end of the flexible cable 43 is connected to a side face of the piezoelectric element 41 at a side opposite the fixing plate 42 at the fixed end while the other end of the flexible cable 43 is connected to the control unit of the printer 1. A connection between the flexible cable 43 and the control unit is omitted in the drawings. The fixing plate 42 that supports each piezoelectric element 41 is made of a metal plate that can receive a reaction force from the piezoelectric element 41. In the embodiment, the metal plate is made of stainless steel (SUS) having a thickness of about 1 millimeter (mm).

The channel unit 35 includes the nozzle forming base plate 45, a channel unit forming base plate 46, and a vibration plate 47. In the channel unit 35, the nozzle forming base plate 45 is disposed and superposed on the one face of the channel unit forming base plate 46 while the vibration plate 47 is disposed and superposed on the other face of the base plate 46 that is a side opposite the nozzle forming base plate 45. The plates 45, 46 and 47 are integrated using an adhesive.

The nozzle forming base plate 45 is a thin plate made of a silicon single crystal. An array including a plurality of nozzles 48 is provided on the thin plate at a pitch corresponding to a dot forming density. The array of the nozzles 48 constitutes the nozzle array 49. In the embodiment, for example, the nozzle array 49 including the one hundred and eighty (180) nozzles 48 is arranged in the width direction of the paper. The bottom face (a face at a side opposite the channel unit forming base plate 46) of the nozzle forming base plate 45 corresponds to the nozzle face 50 in the invention.

The channel unit forming base plate 46 is a plate-like member that forms an ink channel unit including the reservoir (a common liquid chamber) 51, an ink supply port 52, and a pressure chamber 53. The channel unit forming base plate 46 in the embodiment is formed by etching a silicon single crystal base plate. The reservoir 51 is a hollow space that introduces the ink into a plurality of pressure chambers 53 in common. An end of the reservoir 51 in the direction of the nozzle array 49 communicates with the casing channel unit 39 through the ink induction port in the vibration plate 47. The ink supply port 52 is formed into a narrow passage that connects the pressure chamber 53 and the reservoir 51 with each other. The pressure chamber 53 is a narrow chamber elongated in a direction perpendicular to the direction of the nozzle array 49. The pressure chamber 53 is divided into a plurality of sections by partitions in correspondence with the plural nozzles 48.

The vibration plate 47 is a double structural composite plate which is laminated with a resin film 56 such as polyphenylene sulfide (PPS) on the metal support plate 55 made of stainless steel (SUS) or the like. The vibration plate 47 is provided with the ink induction port that connects the reservoir 51 and the casing channel unit 39 with each other and that extends in the vibration plate 47 in the vertical direction. The vibration plate 47 is provided with the diaphragm section 57 that closes one open face (a face opposite the nozzle forming base plate 45) of the pressure chamber 53 so as to change a volume of the pressure chamber 53 and is provided with a compliance section 59 that closes one open face (a face opposite the nozzle forming base plate 45) of the reservoir 51. In more detail, the diaphragm section 57 is made removing an annular part of the support plate 55 corresponding to the pressure chamber 53 by etching, and by forming a plurality of islands 58 that are each connected to a free distal end of the piezoelectric element 41. Each island 58 has the same plan shape as that of the pressure chamber 53 and is formed into a block-like shape that extends in a direction perpendicular to the nozzle array 49. The resin film 56 around the island 58 serves as an elastic film. In the part that serves as the compliance section 59, that is, in the part opposing the reservoir 51, the support plate 55 is removed by etching so as to have only the resin film 56.

The recording head body 32 as described above introduces the ink from the ink tank 3 through the ink supply tube 8 and the communication hole 30 in the base plate 24. Thus, the ink fills a series of a channel unit including the casing channel unit 39, the reservoir 51, the ink supply port 52, and the pressure chamber 53. When a driving signal is applied from the control unit of the printer 1 to the recording head body 32, the free ends of the piezoelectric elements 41 are expanded and retracted so as to change a pressure in the pressure chamber 53. By controlling the pressure fluctuations, the ink drops are ejected from the nozzle 48 that communicates with the pressure chamber 53, or a meniscus in the nozzle 48 finely vibrates to the extent to which the nozzle 48 does not eject the ink.

The head fixing member 33 is a thin plate-like member made of a metal, for example, stainless steel (SUS) or the like that has stiffness higher than the head casing 37. The head fixing member 33 is secured to a fixing face, opposing the attachment face 27 of the base plate 24, in the head casing 37 so as to define a relative position between the head fixing member 33 and the nozzle 48.

A dimension of the head fixing member 33 in the direction of the nozzle array 49 is longer than that of the head casing 37 in the same direction. A dimension (a height) of the head fixing member 33 in a direction perpendicular to the nozzle face 50 is shorter (lower) than a dimension (a height) of the head casing 37. The upper face of the head fixing member 33 is aligned with the upper face of the recording head body 32. The head fixing member 33 is attached to the head casing 37 in a state in which a relative position between the nozzle 48 (the reference nozzle in position) of the nozzle face 50 and the head fixing member 33 is defined. When the head fixing member 33 is attached to the head casing 37, the opposite ends of the head fixing member 33 in the direction of the nozzle array 49 project outward from the head casing 37 (the recording head body 32). The head fixing member 33 is provided with first tapped holes 61 that extend in the thickness direction of the member 33 and that correspond to the head tapped holes 40 in the head casing 37. Also, the head fixing member 33 is provided on its portion projecting outward from the head casing 37 with second tapped holes 62 that extend in the thickness direction of the member 33 and that correspond to the tapped holes 29 for attaching the recording head in the base plate 24. In more detail, stiffness of at least a portion between the tapped holes 61 in the head fixing member 33 is higher than stiffness of a portion between the tapped holes 40 in the head casing 37. In other words, if the same force is applied to the portion between the tapped holes 40 and to the portion between the tapped holes 61, the head casing 37 may be deformed more greatly than the head fixing member 33. The stiffness may be affected by at least a material and a structure.

Each head fixing member 33 in the embodiment is provided on its face at a side of the base plate 24 (at a side opposite the head casing 37) and at a portion inside the first tapped holes 61 with an engagement projection 63 (corresponding to an engagement portion in the invention) that projects toward the base plate 24. In other words, a thickness of the head fixing member 33 at the portion inside the first tapped holes 61 is larger than the other portions. Each engagement projection 63 includes a first defining face 63*a* that contacts the first receiving face 28*a* of each engagement recess 28, and second defining faces 63*b* that contact the second receiving faces 28*b* of each engagement recess 28. When the first defining face 63*a* contacts the first receiving face 28*a*, the position of each recording head 7 is defined with respect to each base plate 24 in the direction perpendicular to the nozzle array 49 in the surface parallel to nozzle face 50. When the second positioning receiving faces 28*b* of the engagement recess 28 contact the second defining faces 63*b* opposing the faces 28*b*, the position of the recording head 7 is defined with respect to the base plate 24 in the direction of the nozzle array 49 in the surface parallel to nozzle face 50. In other words, when the engagement projection 63 is fitted in the engagement recess 28, the attaching position of the recording head 7 on the base plate 24 in the direction of the nozzle face 50 is defined.

Next, a method for producing the recording head unit 2 as described above will be explained below.

First, a face opposite the engagement projection 63 of the head fixing member 33 is pressed onto a face opposing the attachment face 27 of the base plate 24 in the recording head body 32 (the head casing 37). The tapped holes 40 for attaching the head fixing member 33 are overlapped with the first fixing tapped holes 61 and the holes 40 and 61 are fixed to each other temporally. In this state, a relative position between the head fixing member 33 and the nozzle 48 of the recording head body 32 is corrected by using a jig or the like. For example, by using a camera or the like, a relative position between the nozzles 48 (the reference nozzle) on both ends of the nozzle array 49 and both ends of the head fixing member 33 (or alignment marks provided on the head fixing member 33 in advance) is observed and the tapped holes 40 and 61 are fastened by screws while correcting the relative position between them. Consequently, the recording head 7 can be made in which the relative position between the head fixing member 33 and the nozzle 48 is defined.

Figure 7:
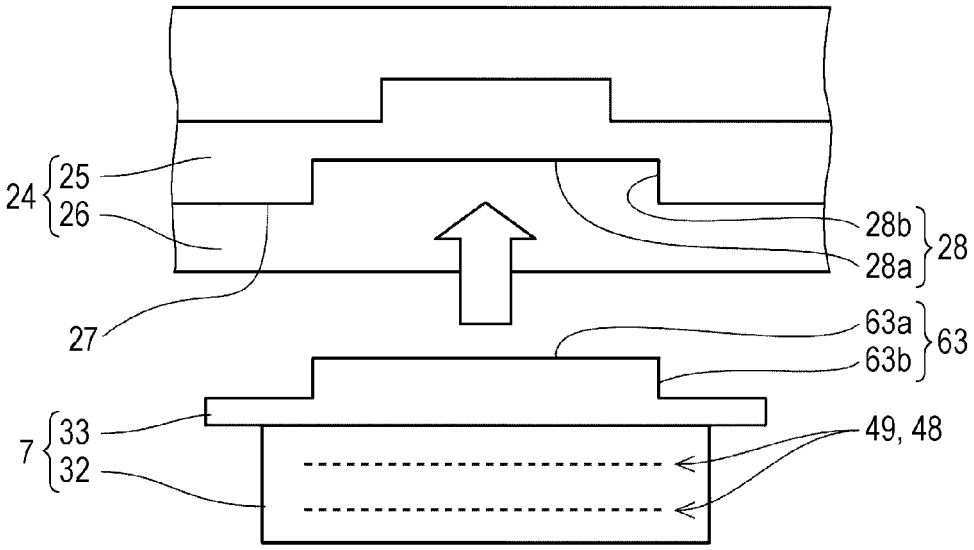
FIG. 7 is a schematic plan view of the recording head, illustrating an operation of mounting the recording head on the base plate.

Next, as shown in FIG. 7, the head fixing member 33 of the recording head 7 described above is approached to the attachment face 27 on the base plate 24 so that the engagement projection 63 is fitted into the engagement recess 28 and the head fixing member 33 is pressed onto the attachment face 27 of the base plate 24. In this state, the screws are threaded through the second fixing tapped holes 62 into the recording head attachment tapped holes 29 so as to attach the recording head 7 to the base plate 24. At this time, since the engagement projection 63 is fitted in the engagement recess 28, the position of the recording head 7 on the base plate 24 in the direction of the nozzle face 50 can be defined.

The position of the recording head 7 on the base plate 24 may be defined by bringing the thin portion outside the engagement projection 63 of the head fixing member 33 into contact with the edge around the engagement recess 28 in the attachment face 27. In the embodiment, since the base plate 24 and the head fixing member 33 are made of a metal material such as stainless steel (SUS), that is, a material having a high stiffness, it is possible to prevent both members from being deformed. An accurate positioning between the recording head 7 and the base plate 24 can be accomplished merely by fitting the engagement projection 63 into the engagement recess 28 and by pressing the head fixing member 33 onto the attachment face 27 on the base plate 27.

A procedure for attaching the recording head 7 to the base plate 24 is repeated by the number of the recording heads 7 to be attached to the base plate 24 so as to make the recording head unit 2. In the case of making the recording head unit 2 in the embodiment, first eight recording heads 7 that each define the relative position between the head fixing member 33 and the nozzle 48 are made, and the respective recording heads 7 are mounted on the attachment faces 27 on the base plate 24. Even in the case of replacing one or more recording heads 7 upon a repairing operation or the like, after the recording head 7 to be replaced is removed from the base plate 24, a new recording head 7 is mounted on the base plate 24.

Thus, since the head fixing member 33 having the stiffness higher than that of the head casing 37 is fixed to the base plate 24, the head fixing member 33 can be prevented from being deformed, and when the recording head 7 is mounted on the base plate 24, misalignment of the recording head 7 can be prevented. Thus, it is possible to enhance workability of attaching the recording head 7 to the base plate 24. Since the head fixing member 33 is pressed onto and is fixed to the attachment face 27 on the base plate 24, the positioning operation of the recording head 7 becomes easy. In particular, when the recording head 7 is replaced due to a failure or the like, the positioning operation of the recording head 7 becomes easy. Accordingly, it is easy for a customer who uses the printer 1 to replace the recording head 7. Furthermore, since the engagement projection 63 of the head fixing member 33 is fitted in the engagement recess 28 of the base plate 24, it is possible to enhance an accuracy of positioning the recording head 7 in the direction of the nozzle face 50.

It should be noted that the invention is not limited to the embodiment described above and that the embodiment can be altered variously in accordance with the scope of the claims.

For example, although the engagement projections 63 are provided on the head fixing members 33 and the engagement recesses 28 are provided on the base plate 24 in the above embodiment, the invention is not limited thereto. For example, the engagement recesses may be provided on the head fixing members and the engagement projections may be provided on the base plate. Alternatively, the engagement projections and recesses may not be provided on both members and the faces of the members opposing each other may be formed into flat faces. In this case also, by bringing the faces of the members opposing each other into contact with each other, it is possible to define the positions of the recording heads on the base plate in the direction perpendicular to the nozzle arrays in a surface parallel to the nozzle faces.

Although the base plate 24 and the head fixing members 33 are secured to each other by screws and the recording head bodies 32 and the head fixing members 33 are secured to each other by screws in the above embodiment, the invention is not limited thereto. For example, the respective members may be adhered to each other by using an adhesive such as a ultraviolent (UV) curing resin or a sealant.

Although the so-called longitudinal vibration type piezoelectric elements 41 are exemplified as a pressure generation unit in the above embodiment, the invention is not limited thereto. For example, so-called deflection vibration type piezoelectric elements may be adopted. Furthermore, any pressure generation unit may be adopted in the invention. The pressure generation unit includes a heating element that generates pressure fluctuations by forming air bubbles by means of liberating heat, a static electric actuator that generates pressure fluctuations by displacing an actuating face of a pressure chamber by means of a static electric force, and the like.

The invention is not limited to the printer as long as the liquid ejecting apparatus is provided with a liquid ejecting head that ejects an ink or the like from a nozzle. The invention may adopt a liquid ejecting apparatus that includes various kinds of ink jet type recording apparatus such as a plotter, a facsimile apparatus, a copy apparatus, or the like, and may adopt a liquid ejecting apparatus except the recording apparatus, for example, a display producing apparatus, an electrode producing apparatus, a chip producing apparatus, or the like.

What is claimed is:

1. A liquid ejecting head unit comprising:

a liquid ejecting head that ejects a liquid from a nozzle in a nozzle surface, the liquid ejecting head having a fixing face to be used for attachment, the fixing face being perpendicular to the nozzle surface and including a fixing hole extending perpendicularly through the fixing face;

a head fixing member that has stiffness higher than that of the fixing face and that is secured to the fixing face on the liquid ejecting head, the head fixing member including another fixing hole complementary with the fixing hole; and a support member that has an attachment face to which the liquid ejecting head is attached through the head fixing member, wherein the head fixing member has a first face that is secured to the fixing face and a second face that is opposite the first face, the second face including a first portion that is parallel to the first face and a second portion that protrudes from the first portion, the second portion being configured to fit into an engagement receiving section of the support member.

2. The liquid ejecting head unit according to claim 1, wherein the fixing face of the liquid ejecting head is made of a resin; and the head fixing member is made of a metal.

3. A liquid ejecting apparatus having the liquid ejecting head unit according to claim 1.

4. A liquid ejecting head set to be mounted on an attachment face of a support member, comprising:

a liquid ejecting head that has a fixing face to be used for attachment and that ejects a liquid from a nozzle, the fixing face being perpendicular to the nozzle surface and including a fixing hole extending perpendicularly through the fixing face; and a head fixing member that has stiffness higher than that of the fixing face and that is secured to the fixing face of the liquid ejecting head;

the head fixing member being provided with an engagement protrusion to be attached to the attachment face of the support member, wherein the engagement protrusion has a first face that is secured to the fixing face and a second face that is opposite the first face, the second face including a first portion that is parallel to the first face and a second portion that protrudes from the first portion, the second portion being configured to fit into an engagement receiving section of the support member.

5. The liquid ejecting head unit according to claim 1, wherein the support member includes a flange portion configured as a base for the liquid ejecting head and a protruding portion that is perpendicular to the flange portion and a nozzle surface of the ejecting head, the protruding portion comprising an attachment surface.

6. The liquid ejecting head unit according to claim 1, wherein the head fixing member is longer than the fixing face of the liquid ejecting head in a direction in which the nozzle is arranged in line.

7. The liquid ejecting head unit according to claim 1, wherein the head fixing member is shorter than the fixing face of the liquid ejecting head in a direction perpendicular to a nozzle face where the nozzle is arranged.

8. The liquid ejecting head set according to claim 4, wherein the head fixing member is longer than the fixing face of the liquid ejecting head in a direction in which the nozzle is arranged in line.

9. The liquid ejecting head set according to claim 4, wherein the head fixing member is shorter than the fixing face of the liquid ejecting head in a direction perpendicular to a nozzle face where the nozzle is arranged.

10. The liquid ejecting head unit according to claim 1, wherein the second portion includes a first fixing hole configured to align with the fixing hole provided in the liquid ejecting head.

11. The liquid ejecting head unit according to claim 1, wherein the second portion includes a second fixing hole configured to align with a third fixing hole provided in the support member.

12. The liquid ejecting head set according to claim 4, wherein the second portion includes a first fixing hole configured to align with the fixing hole provided in the liquid ejecting head.

13. The liquid ejecting head set according to claim 4, wherein the second portion includes a second fixing hole configured to align with a third fixing hole provided in the support member.

14. The liquid ejecting head unit according to claim 1, further comprising a fastener extending through the another fixing hole and into the fixing hole, the fastener correcting a relative position between the fixing face and the head fixing member.

15. The liquid ejecting head set according to claim 4, wherein the head fixing member includes another fixing hole complementary with the fixing hole and the liquid ejecting head set further comprising a fastener extending through the another fixing hole and into the fixing hole, the fastener correcting a relative position between the fixing face and the head fixing member.

* * * * *